US007117604B2

(12) United States Patent
Khoshnood

(10) Patent No.: US 7,117,604 B2
(45) Date of Patent: Oct. 10, 2006

(54) ADJUSTABLE BOW SIGHT

(76) Inventor: Bahram Khoshnood, 1360 Union Hill Rd., Suite 3C, Alpharetta, GA (US) 30004

( * ) Notice: Subject to any disclaimer, the term of this patent is extended or adjusted under 35 U.S.C. 154(b) by 0 days.

(21) Appl. No.: 10/987,539

(22) Filed: Nov. 15, 2004

(65) Prior Publication Data

US 2006/0101657 A1 May 18, 2006

(51) Int. Cl.
*F41G 1/467* (2006.01)

(52) U.S. Cl. ..... 33/265; 124/87

(58) Field of Classification Search ..... 33/265; 124/87

See application file for complete search history.

(56) References Cited

U.S. PATENT DOCUMENTS 4,532,717 A 8/1985 Watson et al. ..... 33/265
4,543,728 A * 10/1985 Kowalski ..... 33/265
5,092,052 A * 3/1992 Godsey ..... 33/265
5,289,814 A * 3/1994 Maisano ..... 124/87
5,367,780 A * 11/1994 Savage ..... 33/265
5,465,491 A 11/1995 Thell ..... 33/265
5,632,091 A * 5/1997 Brion et al. ..... 33/265
5,802,726 A * 9/1998 Trosper, Jr. et al. ..... 33/265
6,134,794 A * 10/2000 Raukola ..... 33/265
6,418,632 B1 * 7/2002 Kalfayan ..... 33/265
2003/0136012 A1 * 7/2003 Walbrink ..... 33/265
2005/0235503 A1 * 10/2005 Afshari ..... 33/265

* cited by examiner

*Primary Examiner*—Yaritza Guadalupe-McCall
*Assistant Examiner*—Amy R. Cohen
(74) *Attorney, Agent, or Firm*—Rodgers & Rodgers

(57) ABSTRACT

A bow sight having a support member with a sight unit disposed at one end and adjustable sight markers secured to the other end, a pointer associated with the rear end of the support member for alignment with one of the sight markers upon determination of the proper sight unit elevation setting.

9 Claims, 2 Drawing Sheets

ADJUSTABLE BOW SIGHT

BACKGROUND OF THE INVENTION

This invention relates to an improvement in a bow sighting device. Depending on the weight and aerondynamic characteristics of the arrow, a bow sight allows the archer to increase the probability of accurately striking the desired target. Of course, the weight of the arrow requires that the archer aim higher vertically as the distance to the target increases.

Known sighting techniques involve a trial and error system whereby the archer shoots several arrows in order to determine the proper setting for the bow sight and then makes an appropriate mark on a piece of tape adhered to the sight. Additional markings are made on the tape to accommodate different distances to the target. This known bow sight technique is obviously cumbersome and time consuming.

BRIEF SUMMARY OF THE INVENTION

According to this invention, a bow sight is provided and comprises a support member having front and rear ends, a sight unit secured to the front end and a pointer extending from the rear end, a connecting bar for simultaneously adjusting the sight unit and the pointer, and a sight marker adjustably mounted at the rear end for the purpose of alignment with the pointer to accurately calibrate the sight unit.

DETAILED DESCRIPTION OF THE INVENTION

Figure 1:
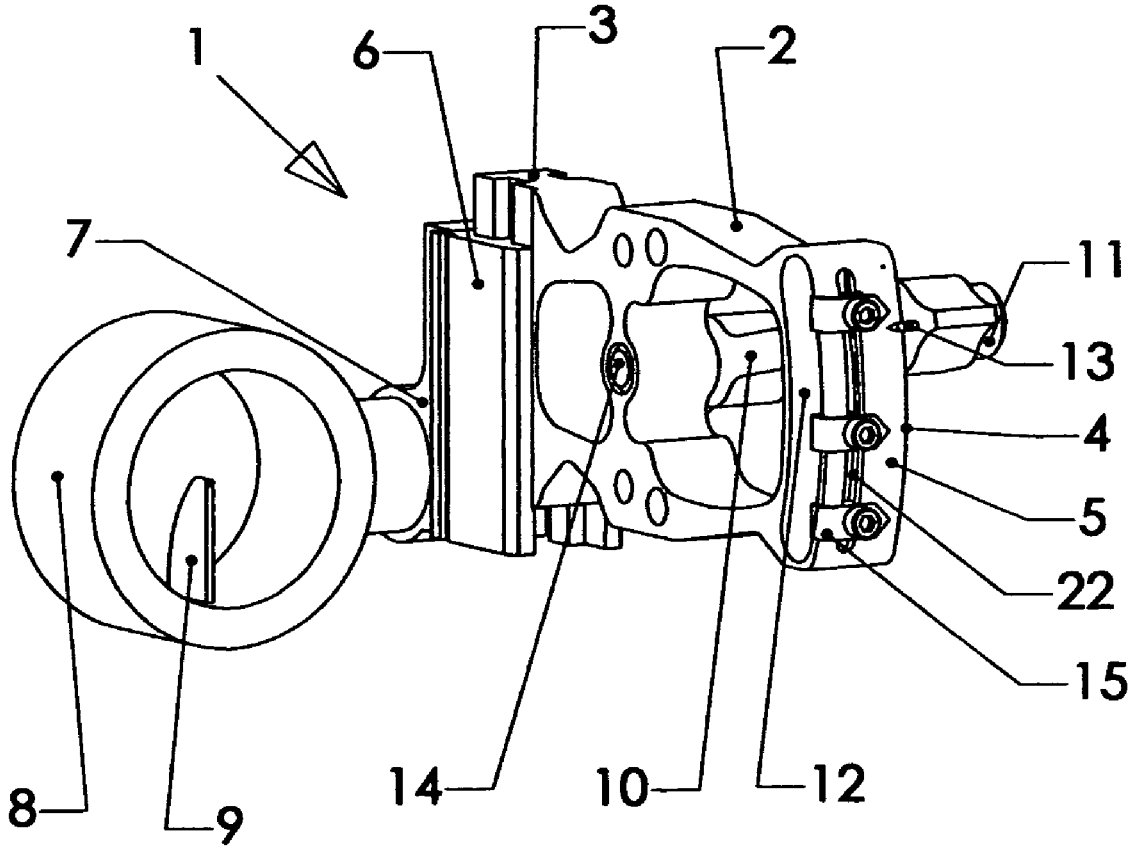
FIG. 1 is a perspective view of a bow sight according to this invention.

With attention to the drawings and with particular reference to FIG. 1, the bow sight, according to this invention, is generally indicated by the numeral 1. Bow sight 1 includes support 2 having front end 3 and rear end 4. Arcuate member 5 is disposed at rear end 4 and mounting member 6 is slidably disposed on front end 3 with clamp 7 extending therefrom. Sight unit 8 is mounted in clamp 7 and sight pin 9 extends inwardly of sight unit 8, as is well known.

Connecting bar 10 includes nut and bolt assembly 11 which cooperates with a ledge (not shown) disposed in slot 12 in order to adjustably fix the end of connecting bar 10 relative to rear end 4 of support 2. In addition, pointer 13 extends from the rear end of connecting bar 10. Also, connecting bar 10 is pivoted at pivot point 14 with the end thereof opposite nut and bolt assembly 11 being pivotally attached to mounting member 6. By loosening nut and bolt assembly 11, connecting bar 10 is allowed to rotate about pivot point 14 and mounting member 6 and associated sight unit 8 are caused to slide with respect to front end 3 and pointer 13 is concurrently caused to slide along arcuate member 5.

Figure 2:
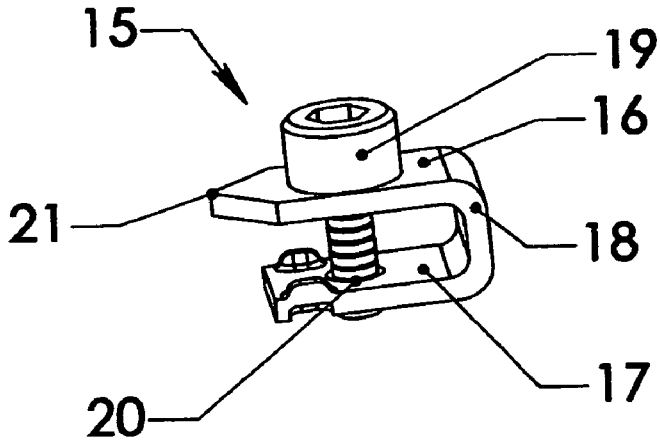
FIG. 2 is an enlarged perspective view of the sight marker.

According to this invention, a sight marker, generally identified by the numeral 15 in FIG. 2, includes clamp elements 16 and 17 joined together by means of neck 18. Screw 19 is rotatable within an aperture formed in clamp element 16 and threaded into threaded aperture 20 formed in clamp element 17. Due to the small size of screw 19, it can be conveniently manipulated by an Allen wrench. Therefore, as screw 19 is rotated in a clockwise direction, clamping elements 17 and 18 are drawn toward each other. Finally, pointed end 21 is formed on the free end of clamp element 16. As shown in FIG. 1, sight markers 15 are slidable along the outer surface of rear end 4 with screw 19 of each sight marker 15 disposed in slot 22.

Figure 3:
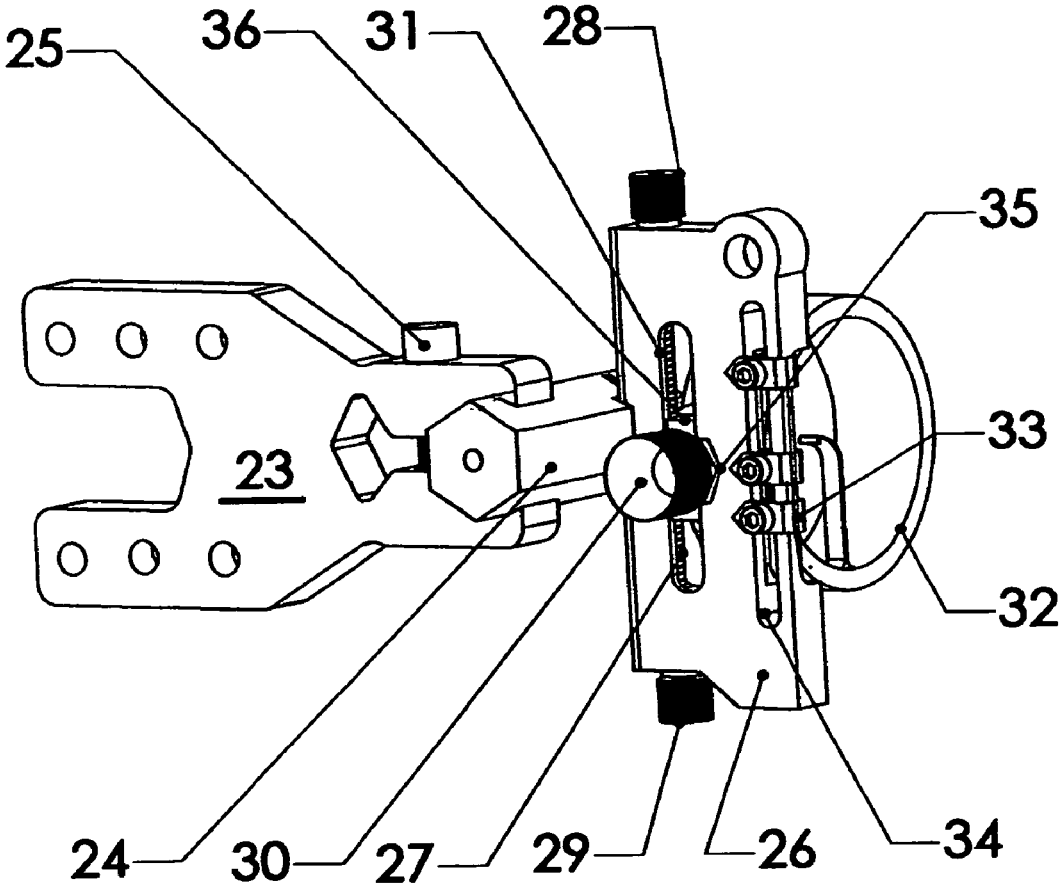
FIG. 3 is a perspective view of a modified form of the invention.

A modification of the bow sight is depicted in FIG. 3 wherein mounting plate 23 is provided with connecting bar 24 secured thereto by means of tightening screw 25. Support 26 is secured to connecting bar 24 and threaded rod 27 is disposed within support 26 with turning knobs 28 and 29 secured to the ends thereof, respectively.

Also, screw 30 is slidable within slot 31 and is screwed into sight unit 32. Finally, sight markers 33 are slidable within slot 34, as discussed above in connection with the version of the invention shown in FIGS. 1 and 2, and pointer 35 is secured to screw 30. In this version of the invention, turning knobs 28 and 29, cause screw 30 to move in one direction or the other because screw 30 is attached to connecting block 36 which is threadedly interconnected with rod 27. Of course, as screw 30 slides in slot 31, pointer 35 moves simultaneously. When sight unit 32 is positioned as desired, the appropriate sight marker 33 is moved so as to come into alignment with pointer 35, as discussed above in connection with FIGS. 1 and 2.

In operation, the archer takes a few practice shots utilizing sight unit 8 in order to determine a baseline for the sight. Then nut and bolt assembly 11 is loosened which causes sight unit 8 to move to a more desired elevation point.

As sight unit 8 is moved, pointer 13 is simultaneously moved along arcuate member 5. When the desired calibration point is reached, screw 19 of one of the sight indicators 15 is loosened and maneuvered within slot 22 to cause pointed end 21 to line up with pointer 13. Then screw 19 is tightened to lock the associated sight marker 15 in place. Depending on the calibration point for an arrow of different speed or flight characteristics and/or a target located at a different distance, this procedure is repeated with different sight settings locked in by means of the remaining sight markers 15. The operation of the bow sight shown in FIG. 3 is essentially the same with pointer 35 and sight markers 33 aligned for different sight settings.

Therefore, by this invention, a bow sight is provided which is easy to use and extremely accurate without the inaccuracies of known manual marking sights. In addition, the sight is easily adjustable and accommodates a wide range of calibration settings.

The invention claimed is:

1. A bow sight comprising a support, said support having spaced front and rear ends, a sight unit slidably secured to said front end, a slot formed in said rear end, a connecting bar adjustably connected to said support member, a pointer extending from said connecting bar adjacent said rear end, a sight marker slidably disposed in said slot and adapted to align with said pointer by means of adjustment of said connecting bar, and said sight marker comprising a pair of clamp elements connected by a screw.

2. A bow sight according to claim 1 wherein said sight unit is circular and a sight pin extends interiorly of said sight unit.

3. A bow sight according to claim 1 wherein the free end of one of said clamp elements is pointed.

4. A bow sight according to claim 1 wherein the space between said clamp elements is variable.

5. A bow sight according to claim 4 wherein said space is varied by said screw.

6. A bow sight comprising a support, a pair of slots formed in said support, a connecting block slidable in one of said slots, a sight unit affixed to one end of said connecting block, a pointer affixed to the other end of said connecting block, and a sight marker slidable within the other of said slots and adapted to align with said pointer.

7. A bow sight according to claim 6 wherein said pointer is moveable by means of said connecting block being threaded to a rod disposed within said support.

8. A bow sight according to claim 7 wherein a pair of knobs are secured to the ends of said rod respectively.

9. A bow sight comprising a support, said support having spaced front and rear ends, a sight unit slidably secured to said front end, a slot formed in said rear end, said rear end comprising a pair of oppositely disposed sides, a connecting bar adjustably connected to said support and disposed on one side of said rear end, a pointer extending from said connecting bar adjacent said rear end, a sight marker adapted to align with said pointer by means of adjustment of said connecting bar, said sight marker comprising a pair of spaced planar clamp elements connected by means of a neck disposed generally perpendicular thereto, a screw rotatable within an aperture formed in one of said clamp elements and threaded into an aperture formed in the other of said clamp elements, said rear end having a surface disposed on the opposite side thereof from said connecting bar, said neck slidable on said surface, said screw disposed in said slot, and the space between said clamp elements being varied by adjustment of said screw.

* * * * *